US007379873B2

(12) United States Patent
Kemmochi

(10) Patent No.: US 7,379,873 B2
(45) Date of Patent: May 27, 2008

(54) SINGING VOICE SYNTHESIZING APPARATUS, SINGING VOICE SYNTHESIZING METHOD AND PROGRAM FOR SYNTHESIZING SINGING VOICE

(75) Inventor: Hideki Kemmochi, Shizuoka (JP)

(73) Assignee: Yamaha Corporation, Hamamatsu-shi (JP)

( * ) Notice: Subject to any disclaimer, the term of this patent is extended or adjusted under 35 U.S.C. 154(b) by 868 days.

(21) Appl. No.: 10/613,301

(22) Filed: Jul. 3, 2003

(65) Prior Publication Data

US 2004/0006472 A1 Jan. 8, 2004

(30) Foreign Application Priority Data

Jul. 8, 2002 (JP) ..... 2002-198486

(51) Int. Cl.
*G10L 13/06* (2006.01)

(52) U.S. Cl. ..... 704/269; 704/268

(58) Field of Classification Search ..... None
See application file for complete search history.

(56) References Cited

U.S. PATENT DOCUMENTS

| | | | | |
|---|---|---|---|---|
| 5,808,222 | A * | 9/1998 | Yang | 84/603 |
| 6,046,395 | A | 4/2000 | Gibson et al. | |
| 6,304,846 | B1 | 10/2001 | George et al. | |
| 6,307,140 | B1 | 10/2001 | Iwamoto | |
| 6,336,092 | B1 | 1/2002 | Gibson et al. | |

FOREIGN PATENT DOCUMENTS

| | | |
|---|---|---|
| EP | 1 065 651 A1 | 4/2000 |
| EP | 1 220 195 A2 | 7/2002 |
| JP | 5260082 | 8/1993 |
| JP | 07-104792 | 4/1995 |
| JP | 2000-250572 | 9/2000 |
| JP | 2001-013963 | 1/2001 |
| JP | 2001-522471 | 11/2001 |
| JP | 2003087437 | 3/2003 |
| JP | 2003223178 | 8/2003 |

(Continued)

OTHER PUBLICATIONS

Masanobu Abe, "A real time speech quality modification apparatus (VarioVoice)," The Acoustical Society of Japan, Proceedings of the Spring Meeting of 1997 (Japan), p. 269-270, (Mar. 17, 1997).

(Continued)

*Primary Examiner*—Abul K. Azad
(74) *Attorney, Agent, or Firm*—Pillsbury Winthrop Shaw Pittman LLP

(57) ABSTRACT

Voice synthesis unit data stored in a phoneme database 10 is selected by a voice synthesis unit selector 12 in accordance with MIDI information stored in a performance data storage unit 11. Characteristic parameters are derived from the selected voice synthesis unit data. A characteristic parameter correction unit 21 corrects the characteristic parameters based on pitch information, etc. A spectrum envelope generating unit 23 generates a spectrum envelope in accordance with the corrected characteristic parameter. A timbre transformation unit 25 changes timbre by correcting the characteristic parameters in accordance with timbre transformation parameters in a time axis. Timbres in the same song position can be transformed into different arbitrary timbres respectively; therefore, the synthesized singing voice will be rich in variety and reality.

5 Claims, 9 Drawing Sheets

FOREIGN PATENT DOCUMENTS

WO WO 97/15914 5/1997

OTHER PUBLICATIONS

Patent Examiner, "Office Action," Japan Patent Office (Japan), (Mar. 28, 2006).

T. Letowski, "Timbre, Tone Color, and Sound Quality; Concepts and Definitions," *Archives of Acoustics* 17, 1, pp. 17-30 (1992); XP-001-039610.

Minoda, et al., "Speech quality conversion by the formant analysis-synthesis system," The Institute of Electronics, Information and Communication Engineers, Technical Analysis Report "Audio" (Japan), vol. 92 (No. 35), p. 1-8, (May 22, 1992).

Japanese Office Action, Japanese Patent Office (Japan), (Dec. 12, 2006).

* cited by examiner

FIG.1C

ARTICULATION DATA

| FIRST PHONEME NAME | FOLLOW-ING PHONEME NAME | HARMONIC COMPONENT (CHARACTERISTIC PARAMETER CHAIN) | STOCHASTIC COMPONENT (SPECTRUM CHAIN) |
|---|---|---|---|
| # | s | | |
| s | a | | |
| a | i | | |
| i | t | | |
| t | a | | |

.....

STATIONARY DATA

| PHONEME | HARMONIC COMPONENT (CHARACTERISTIC PARAMETER CHAIN) | STOCHASTIC COMPONENT (SPECTRUM CHAIN) |
|---|---|---|
| a | | |
| i | | |

.....

SINGING VOICE SYNTHESIZING APPARATUS, SINGING VOICE SYNTHESIZING METHOD AND PROGRAM FOR SYNTHESIZING SINGING VOICE

CROSS REFERENCE TO RELATED APPLICATION

This application is based on Japanese Patent Application 2002-198486, filed on Jul. 8, 2002, the entire contents of which are incorporated herein by reference.

BACKGROUND OF THE INVENTION

A) Field of the Invention

This invention relates to a singing voice synthesizing apparatus, a singing voice synthesizing method and a program for singing voice synthesizing for synthesizing a human singing voice.

B) Description of the Related Art

In a conventional singing voice synthesizing apparatus, data obtained from an actual human singing voice is stored in a database, and data that agrees with contents of an input performance data (a musical note, lyrics, an expression, etc.) is chosen from the database. Then, a singing voice close to the real human singing voice is synthesized based on the chosen data.

When a human sings a song, it is normal to sing by changing a timbre of a voice by musical contexts (the position in a music, a musical expression, etc.). For example, although the first half portion of a song is sung ordinarily, the second half is sung with feeling even if they have the same lyrics. Therefore, in order to synthesize a natural singing voice by a singing voice synthesizing apparatus, it will be necessary to change the timbre of a voice in the song in accordance with the musical context.

However, in the conventional singing voice synthesizing apparatus, inputting singer's data, changing the way of singing was performed in correspondence to a singer's difference, and in the case of the same singer, basically only one phoneme template was used to the same phoneme context, and attaching the variation of timbre was not performed. Therefore, the singing voice to be synthesized was deficient in change of timbre.

SUMMARY OF THE INVENTION

It is an object of the present invention to provide a singing voice synthesizing apparatus that can synthesize a singing voice with rich musical expression.

According to one aspect of the present invention, there is provided a singing voice synthesizing apparatus, comprising: a singing voice information input device that inputs singing voice information for synthesizing singing voice; a phoneme database that stores voice synthesis unit data; a selector that selects the voice synthesis unit data stored in the phoneme database in accordance with the singing voice information; a timbre transformation parameter input device that inputs a timbre transformation parameter for transforming timbre; and a singing voice synthesizer that generates a synthetic singing voice of which character is changed by transforming the voice synthesis unit data in accordance with the timbre transformation parameter.

According to the above-described singing voice synthesizing apparatus, timbre of a singing voice to be synthesized can be changed by changing timbre transformation parameters. Therefore, even if the same characteristic parameters, that is, the same singing portion, appear almost simultaneously in time, the apparatus can synthesize respectively arbitrary different timbre, and the synthesized singing voice can be rich in change and can be full of the reality.

According to the present invention, vocal quality conversion parameters can be changed in a time axis. By that, even if the same characteristic parameters, that is, the same song portion, that appear almost simultaneously in a time axis, they can be transformed into different arbitrary timbre respectively, and so the synthesized singing voice can be rich in variety and reality.

BRIEF DESCRIPTION OF THE DRAWINGS

FIGS. 1A to 1C are functional block diagrams of a singing voice synthesizing apparatus according to a first embodiment of the present invention.

DETAILED DESCRIPTION OF THE PREFERRED EMBODIMENTS

Figure 1A:
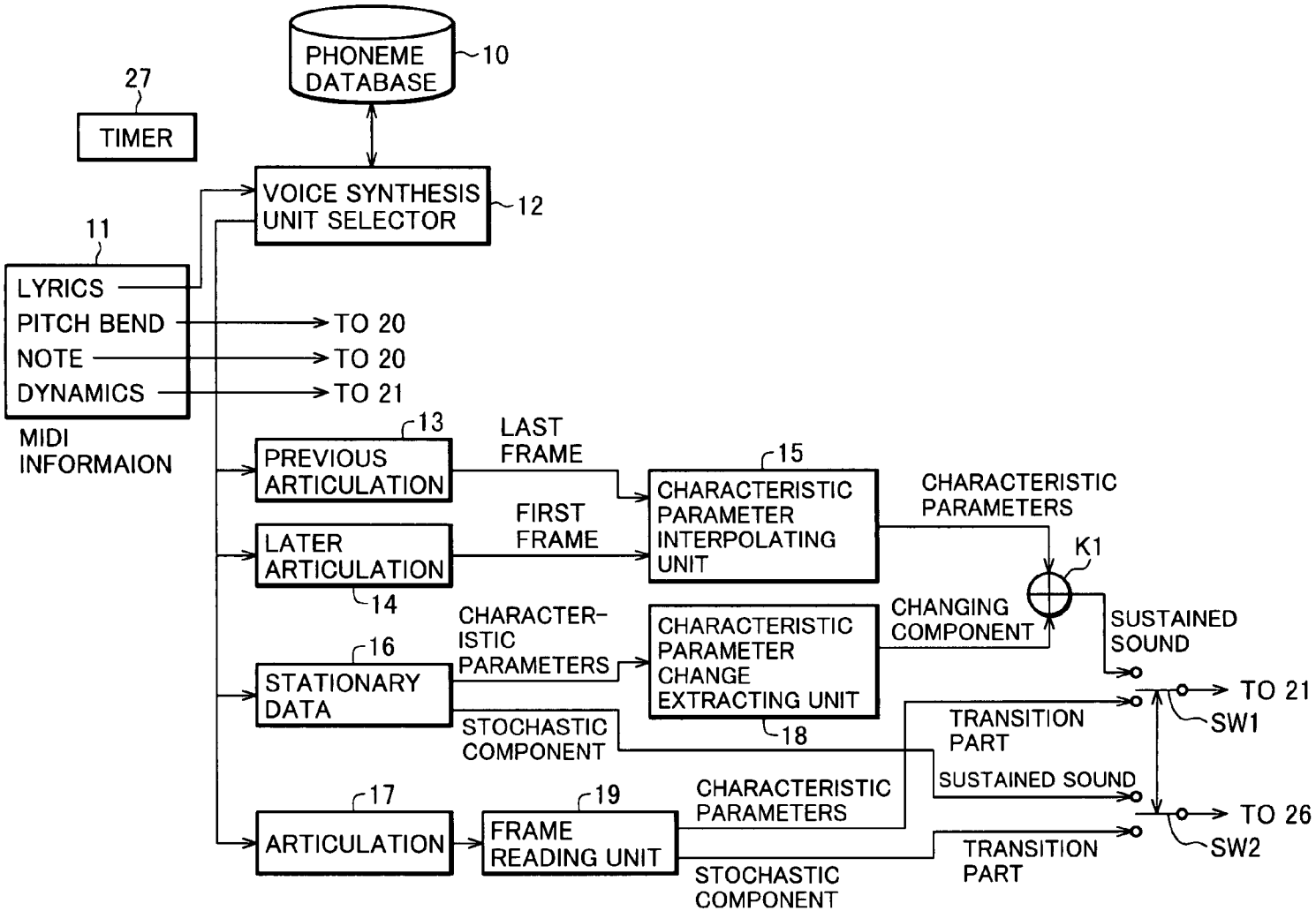
Figure 1B:
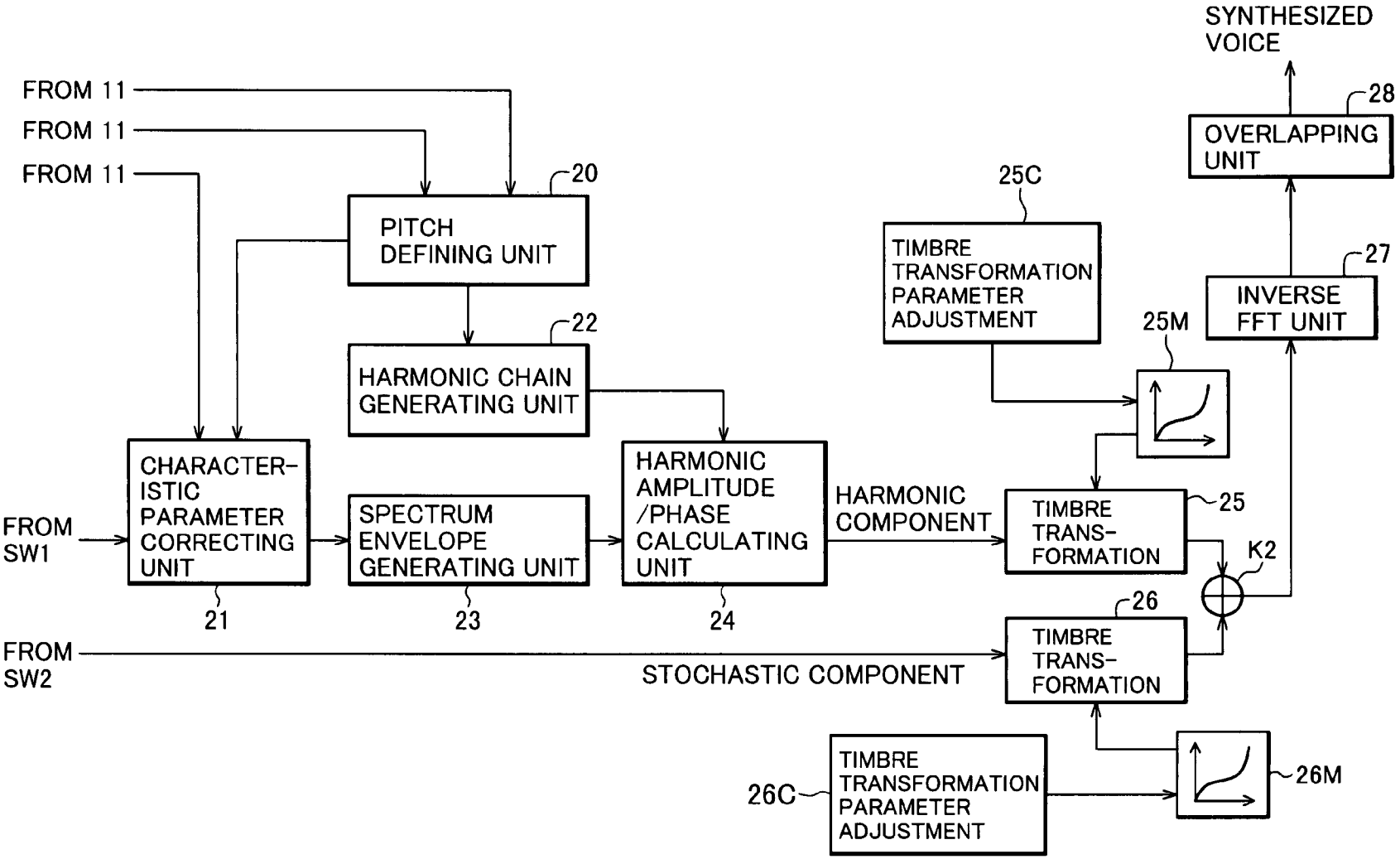

FIGS. 1A to 1C are functional block diagrams of a singing voice synthesizing apparatus according to a first embodiment of the present invention. A phoneme database 10 in the singing voice synthesizing apparatus holds phonemic transition data and stationary part data derived from the recorded song data. Singing performance data in a musical performance data holding unit 11 is divided into articulation parts and sustained parts, and the phonemic transition data is basically used as it is. Therefore, synthetic singing voice in the articulation part holding an important part of the singing voice sounds natural, and the quality of the synthesized singing voice is improved. The singing voice synthesizing apparatus works, for example, on a general personal computer, and functions of each block shown in FIGS. 1A to 1C can be done by a CPU, a RAM and a ROM in the personal computer. It can be implemented also on a DSP or a logical circuit.

As described above, the phonemic database 10 has data for synthesizing a singing voice based on singing performance data. An example of the phoneme database 10 is explained with reference to FIG. 2.

Figure 2:
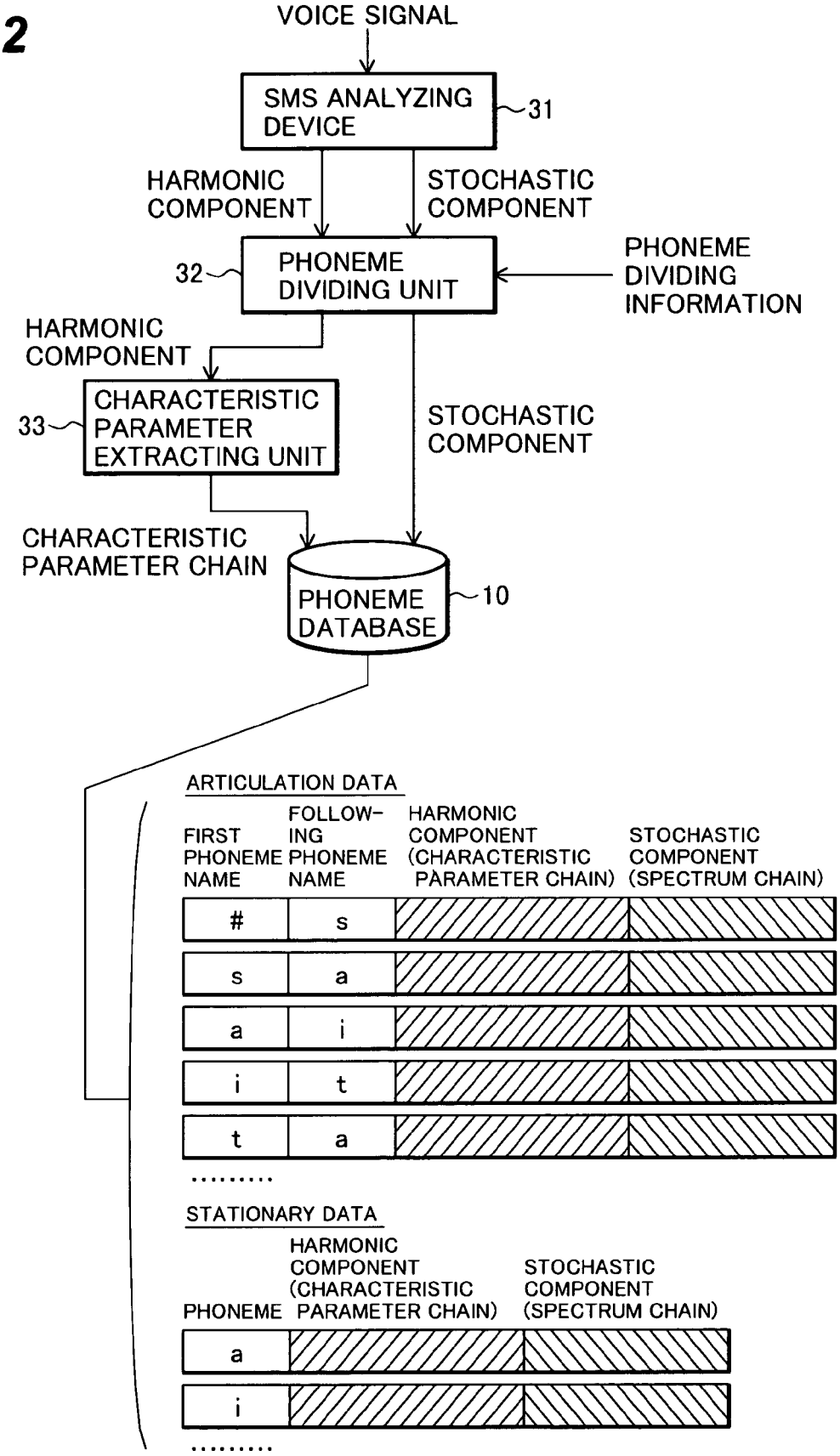
FIG. 2 shows an example of a phoneme database 10 shown in FIG. 1A.

As shown in FIG. 2, a voice signal such as singing data actually recorded is separated into a deterministic component (a sine wave component) and a stochastic component by a spectral modeling synthesis (SMS) analyzing device 31. Other analyzing methods such as a linear predictive coding (LPC), etc. can be used instead of the SMS analysis.

Next, the voice signal is divided by phonemes by a phoneme dividing unit 32 based on phoneme dividing information. For example, the phoneme dividing information is normally input by a human operator with a switch with reference to a waveform of a voice signal.

Then, characteristic parameters are extracted from the deterministic component of the voice signal divided by phonemes by a characteristic parameter extracting unit 33. The characteristic parameters include an excitation waveform envelope, a formant frequency, a formant width, formant intensity, a spectrum of difference and the like.

The excitation waveform envelope (excitation curve) consists of EGain that represents a magnitude of a vocal cord waveform (dB), ESlopeDepth that represents slope for the spectrum envelope of the vocal tract waveform, and ESlope that represents depth from a maximum value to a minimum value for the spectrum envelope of the vocal cord vibration waveform (dB). ExcitationCurve can be expressed by the following equation (A):

$$\text{Excitation Curve}(f)=\text{EGain}+\text{ESlopeDepth}*(\exp(-\text{ESlope}*f)-1) \quad (A)$$

The excitation resonance represents chest resonance. It consists of three parameters: a central frequency (ERFreq), a band width (ERBW) and an amplitude (ERAmp), and has a secondary filtering character.

The formant represents a vocal tract by combining 1 to 12 resonances. They consist of three parameters: a central frequency (Formant Freqi, i is a number of resonance), a band width (FormantBWi, i is a number resonance) and an amplitude (FormantAmpi, i is a number resonance).

The differential spectrum is a characteristic parameter that has a differential spectrum from an original deterministic component, which cannot be expressed by the above three: the excitation waveform envelope, the excitation resonance and the formant.

This characteristic parameter is stored in the phoneme database 10 corresponding to a name of phoneme. The stochastic component is also stored in the phoneme database 10 corresponding to the name of phoneme. In this phoneme database 10, they are divided into articulation (phonemic transition) data and stationary data to be stored as shown in FIG. 2. Hereinafter, "voice synthesis unit data" is a general term for the articulation data and the stationary data.

The articulation data is a chain of data corresponding to the first phoneme name, the following phoneme name, the characteristic parameter and the stochastic component.

On the other hand, the stationary data is a chain of data corresponding to one phoneme name, a chain of the characteristic parameters and the stochastic component.

Back to FIG. 1, a unit 11 is a singing performance data storage unit for storing the singing performance data. The singing performance data is, for example, MIDI information that includes information such as a musical note, lyrics, pitch bend, dynamics, etc.

A voice synthesis unit selector 12 receives an input of performance data kept in the performance data storage unit 11 in a unit of a frame (hereinafter the unit are called the frame data), and reads voice synthesis unit data corresponding to lyrics data included in the input singing performance data by selecting from the phoneme database 10.

A previous articulation data storage unit 13 and a later articulation data storage unit 14 are used for processing the stationary data. The previous articulation data storage unit 13 stores previous articulation data before the stationary data to be processed. On the other hand, the later articulation data storage unit 14 stores later articulation data of stationary data to be processed.

A characteristic parameter interpolation unit 15 reads a parameter of the last frame of the articulation data stored in the previous articulation data storage unit 13 and the characteristic parameters of the first frame of the articulation data stored in the later articulation data storage unit 14, and interpolates the characteristic parameters corresponding to the time directed by the timer 29.

A stationary data storage unit 16 temporarily stores stationary data within the voice synthesis data read by the voice synthesis unit selector 12. On the other hand, an articulation data storage unit 17 temporarily stores articulation data.

A characteristic parameter change extracting unit 18 reads stationary data stored in the stationary data storage unit 16 to extract a change (fluctuation) of the characteristic parameter, and it has a function to output a fluctuation component.

An adding unit K1 is a unit to output deterministic component data of the sustained sound by adding output of the characteristic parameter interpolation unit 15 and output of the characteristic parameter change extracting unit 18.

A frame reading unit 19 reads articulation data stored in the articulation data storage unit 17 as frame data in accordance with a time indicated by a timer 27, and divides into characteristic parameters and a stochastic component to output.

A pitch defining unit 20 defines a pitch in the frame data of the synthesized voice to be synthesized finally based on musical note data and pitch bend data. Also, a characteristic parameter correction unit 21 corrects the characteristic parameter of the sustained sound output from the adding unit K1 and characteristic parameters of the transition part output from the frame reading unit 19 based on pitch defined in the pitch defining unit 20 and dynamics information that is included in performance data. In the preceding part of the characteristic parameter correction unit 21, a switch SW1 is provided, and the characteristic parameter of the sustained sound and the characteristic parameter of the transition part are input in the characteristic parameter correction unit 21. Details of a process in this characteristic parameter correction unit 21 are explained later. A switch SW2 switches the stochastic component of the sustained sound read from the stationary data storage unit 16 and the stochastic component of the transition part read from the frame reading unit 19 to output.

A harmonic chain generating unit 22 generates a harmonic chain for formant synthesizing on a frequency axis in accordance with the determined pitch.

A spectrum envelope generating unit 23 generates a spectrum envelope in accordance with the characteristic parameters that are interpolated in the characteristic parameter correction unit 21.

A harmonics amplitude/phase calculating unit 24 adds an amplitude or a phase of each harmonics generated in the harmonic chain generating unit 22 on the spectrum envelope generated in the spectrum envelope generating unit 23.

The timbre transformation unit 25 has a function to transform timbre of the synthesized singing voice by transforming the spectrum envelope of the deterministic component input via the harmonics amplitude/phase calculating unit 24 based on a timbre transformation parameter input from outside.

Figure 3A:
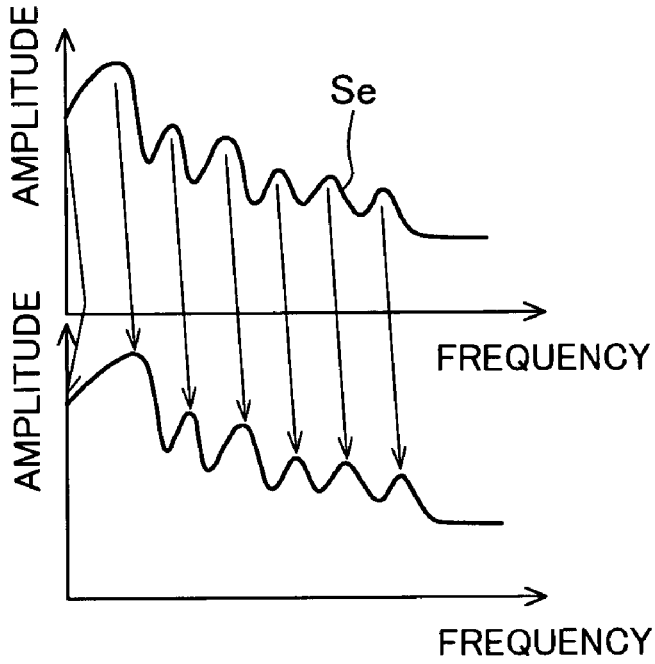
FIGS. 3A and 3B show a way of conversion of input and output by a timbre transformation unit 25 and an example of a mapping function Mf generated in a mapping function generating unit 25M.

The timbre transformation unit 25 executes timbre transformation by shifting local peak positions of input spectrum envelope Se based on the timbre transformation parameter to be input as shown in FIG. 3A. In the case of FIG. 3A, since the local peaks are shifted toward the higher position as a whole, output voice after the transformation is changed to a feminine voice or a childish voice comparing to the voice before the transformation.

Figure 3B:
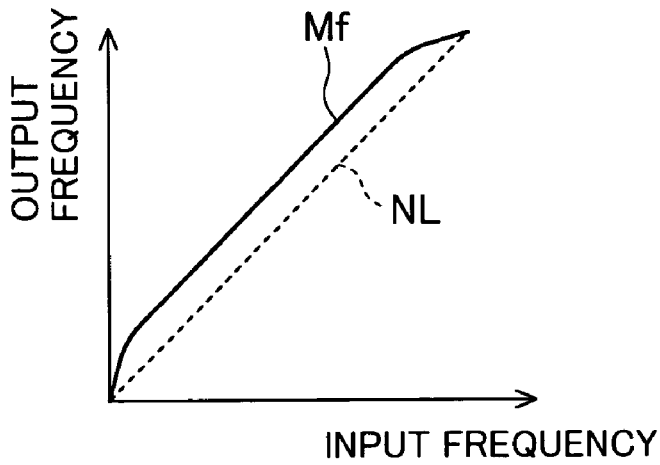

In the embodiment of the present invention, a mapping function Mf as shown in FIG. 3B is generated in a mapping function generation unit 25M based on the timbre transformation parameter output from a timbre transformation parameter adjustment unit 25*c*. The timbre transformation unit 25 shifts the local peak positions of the spectrum envelope based on this mapping function Mf. Horizontal axis of this mapping function Mf is defined as an input frequency (local peak frequency of the spectrum envelope to be input to the timbre transformation unit 25), and vertical axis is defined as an output frequency (local peak frequency of the spectrum envelope to be output from the timbre transformation unit 25). Therefore, in a part where the mapping function Mf is positioned upper side than a straight line indicating "input frequency=output frequency", the local peak shifts in the direction where frequency is high after mapping function Mf conversion. On the other hand, in a part where the mapping function Mf is positioned lower side than a straight line NL, the local peak shifts in the direction where frequency is lower after mapping function Mf conversion.

Then, form of this mapping function Mf can change with time by using the timbre transformation adjustment unit 25C. For example, such conversion is possible at a certain point of time, the mapping function is identical with a straight line NL, and a curve that is symmetrical to the straight line NL is generated as indicated in FIG. 3B in another point of time. By doing this, the timbre of the singing output according to the musical context, etc. changes in time, and a singing voice with a rich expression with much change is possible. As the timbre transformation adjustment unit 25C, for example, a mouse of a personal computer, a keyboard and the like can be used.

Moreover, even if the form of the mapping function Mf is changed in any ways, it is preferable to fix values of the minimum frequency (e.g., 0 Hz in the example shown in FIG. 3A and the maximum frequency in order to maintain the frequency band before and after the timbre transformation.

Figure 4A:
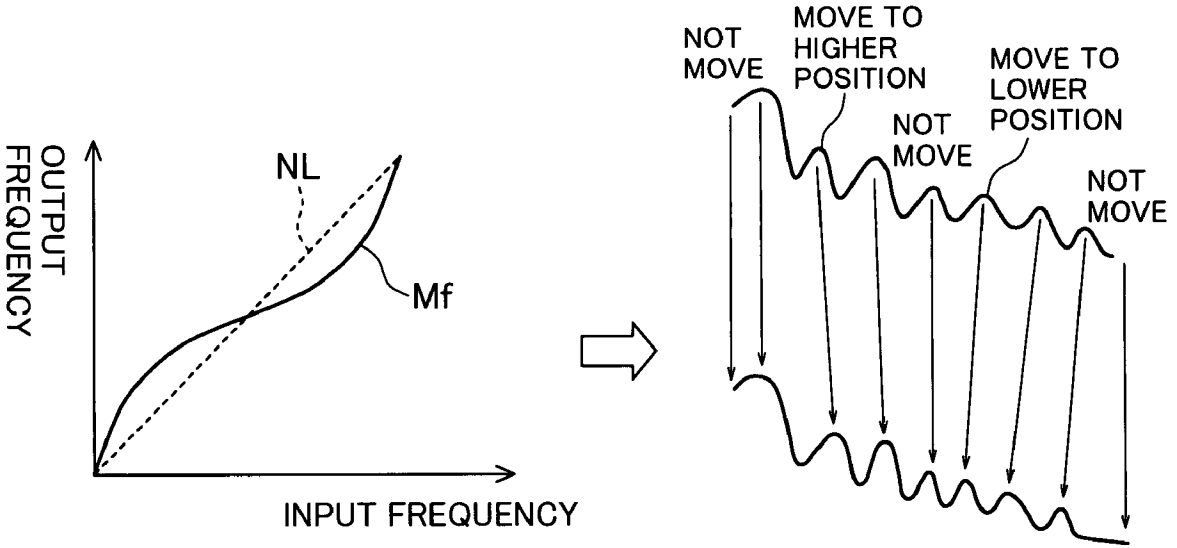
FIGS. 4A and 4B show another example of the mapping function Mf.
Figure 4B:
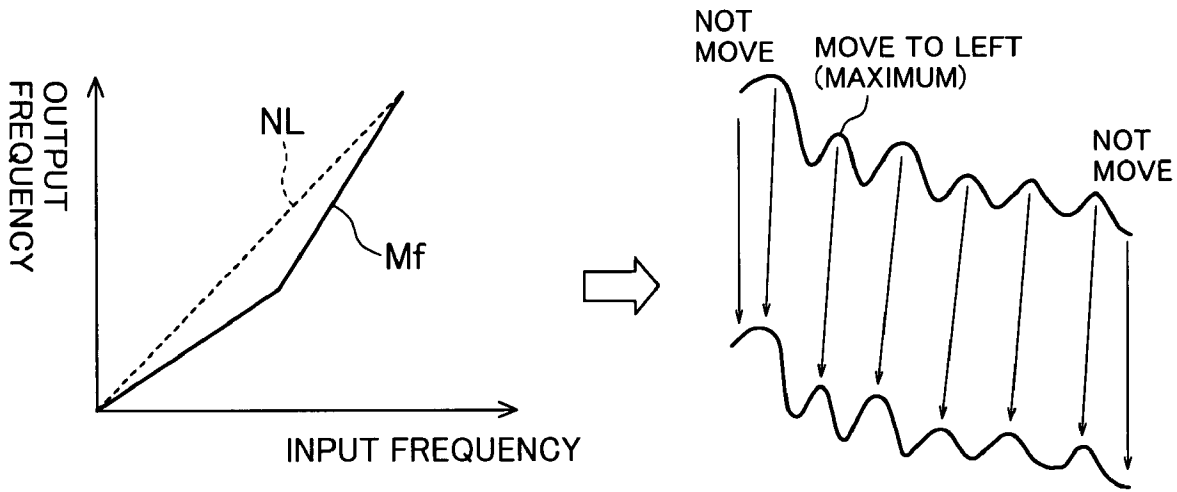

FIGS. 4A and 4B show another examples of the mapping function Mf. FIG. 4A shows an example of the mapping function Mf of which the frequency on the lower frequency side is shifted to higher side and the frequency on the higher frequency side is shifted to lower side. In this case, since the frequency on the lower frequency side that is considered to be important in the auditory sense is shifted to higher side, the output singing voice will sound like childish or duck voice overall. In the mapping function Mf as shown in FIG. 4B, the overall output frequency is shifted to a lower side, and the shifting amount is defined to reach the maximum frequency around a central frequency. In this example, since the frequency is shifted to lower side on the lower frequency side, which is considered to be important in the auditory sense, the output singing voice will be a deep male voice.

Also in the cases of FIGS. 4A and 4B, the form of the mapping function Mf can be changed in time by the timbre transformation adjustment unit 25C.

A timbre transformation unit 26 receives input of the stochastic component output from the frame reading out unit 19 and transforms the spectrum envelope of the stochastic component by using the mapping function Mf' generated in a mapping function generating unit 26M based on the timbre transformation parameters in the same way as the timbre transformation unit 25. The form of the mapping function Mf' can be changed by the timbre transformation parameter adjustment unit 26C.

An adding unit K2 adds the deterministic component as output of the timbre transformation unit 25 and the stochastic component output from the timbre transformation unit 26.

An inverse FFT unit 27 converts a signal in the frequency domain into a signal in the time domain by the inverse fast Fourier transformation (IFFT) of the output value of the adding unit K2.

An overlapping unit 28 outputs a synthesized singing voice by overlapping signals obtained one after another from the inverse FFT unit 27

Details of the chacteristic parameter correction unit 21 are explained with reference to FIG. 5. The chacteristic parameter correction unit 21 equips an amplitude defining unit 41. This amplitude defining unit 41 outputs a desired amplitude value A1 that corresponds to dynamics information input from the singing performance data storage unit 11 by referring a dynamics amplitude transformation table Tda.

Also, a spectrum envelope generating unit 42 generates a spectrum envelope based on the characteristic parameter output from the switch SW1.

A harmonics chain generating unit 43 generates a harmonics based on the pitch defined in the pitch defining unit 20. An amplitude calculating unit 44 calculates an amplitude A2 corresponding to the generated spectrum envelope and harmonics. Calculation of the amplitude can be executed, for example, by the inverse FFT and the like.

An adding unit K3 outputs difference between the desired amplitude value A1 defined in the amplitude defining unit 41 and the amplitude value A2 calculated in the amplitude calculating unit 44. A gain correcting unit 45 calculates amount of the amplitude value based on this difference and corrects the characteristic parameter based on the amount of this gain correction. By doing that, new characteristic parameters matched with desired amplitude are obtained.

Figure 5:
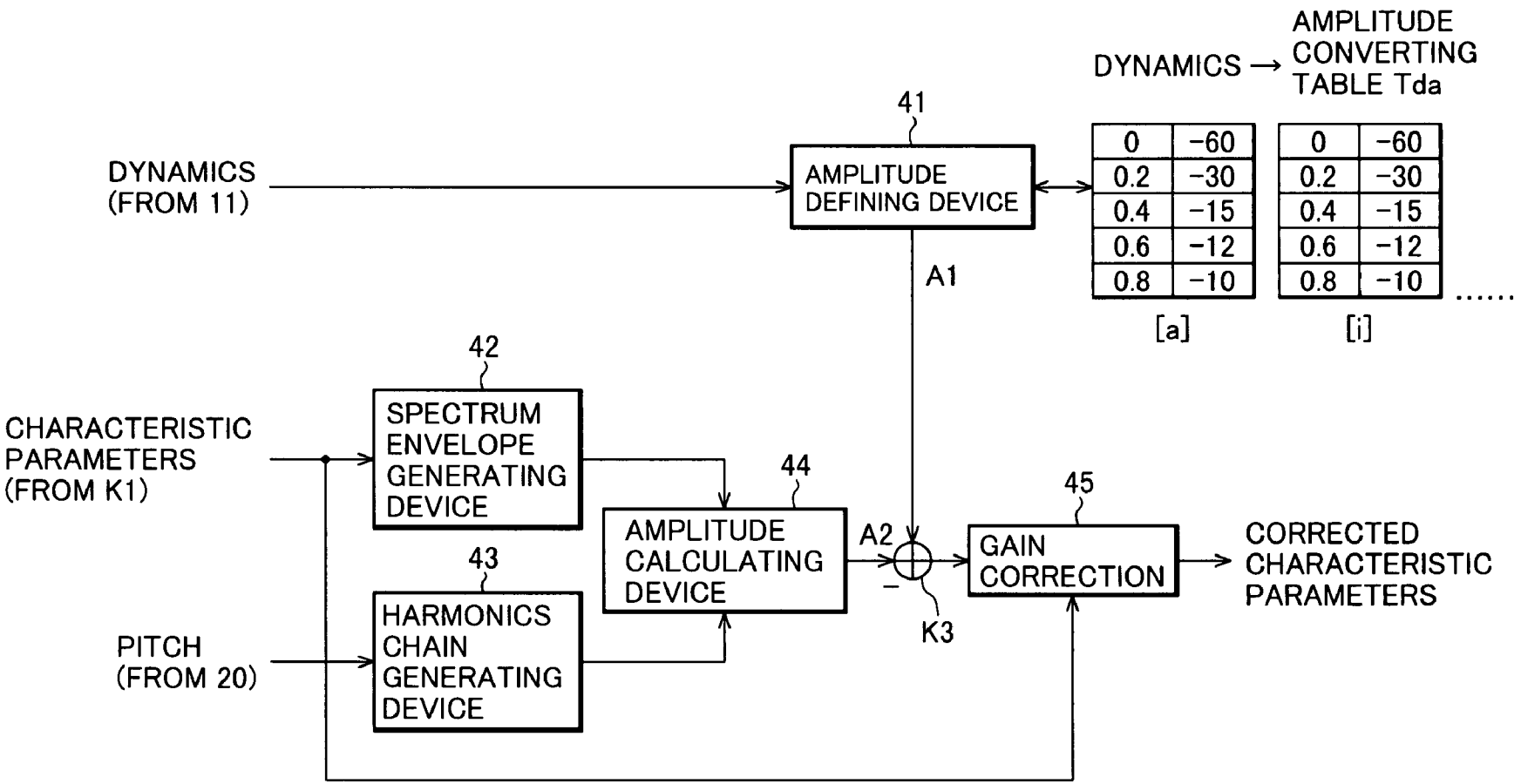
FIG. 5 is a detail of a characteristic parameter correcting unit 21 shown in FIG. 1B.

Further, in FIG. 5, although the amplitude is defined based only on the dynamics with reference to the table Tda, a table for defining the amplitude in accordance with a type of a phoneme can be used in addition to the table Tda. That is, a table that can output different values of the amplitude when the phonemes are different even if the dynamics are same may be used. Similarly, a table for defining the amplitude in accordance with the pitch in addition to the dynamics can also be used.

Figure 6:
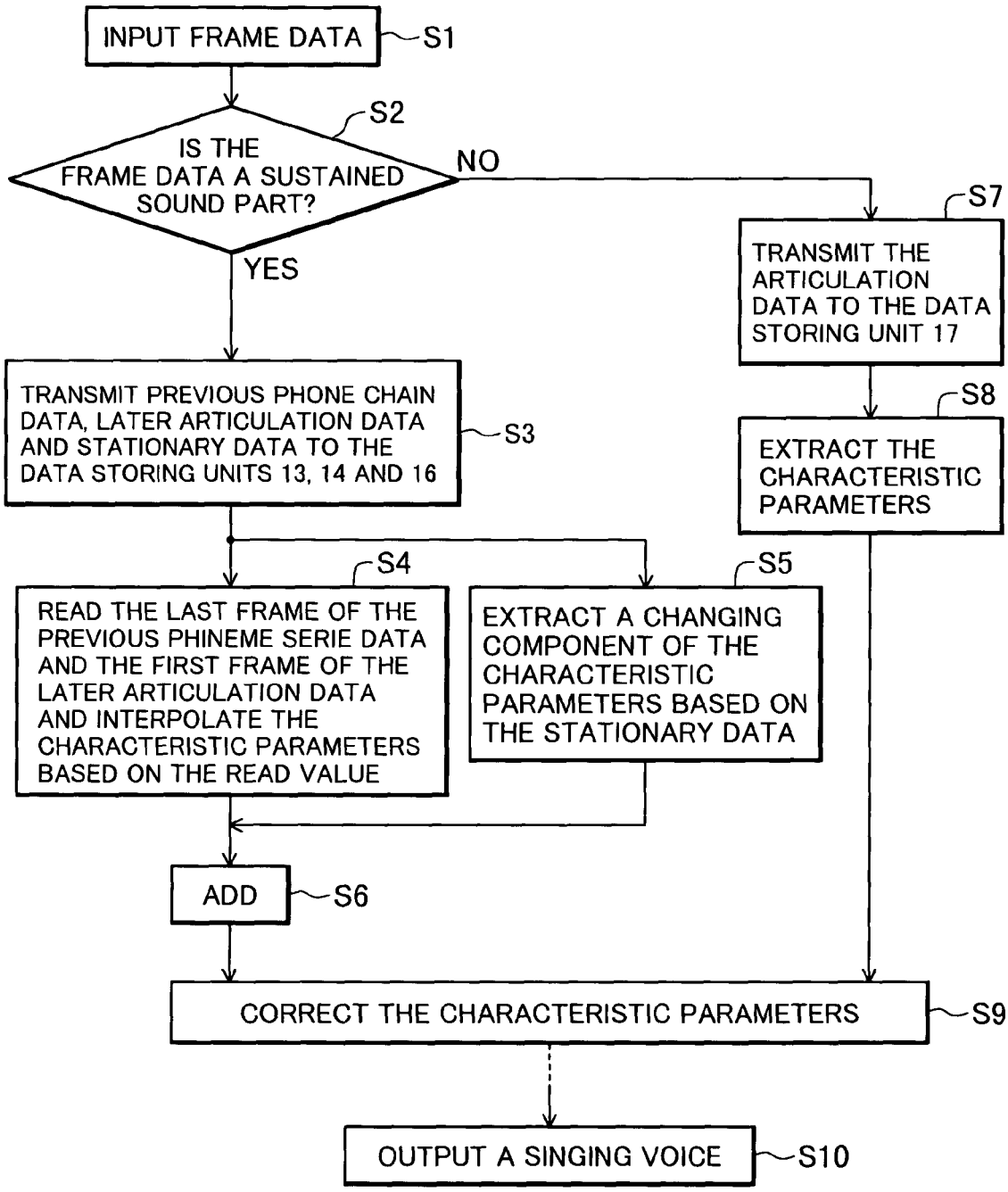
FIG. 6 is a flow chart showing steps of data management in the singing voice synthesizing apparatus according to a first embodiment of the present invention.

Next, the operation of the singing voice synthesizing apparatus according to the present embodiment of the present invention is explained with reference to a flow chart shown in FIG. 6.

The singing performance data storage unit 11 outputs frame data in a time sequential order. A transition part and a sustained part appear alternated, and processes are different for the transition part and the sustained part.

When the frame data is input from the performance data storage unit 11 (S1), it is judged whether the frame data is related to a sustained part or a transition part by a voice synthesis unit selector 12 based on lyrics information in frame data (S2). In a case of the sustained part (YES), previous articulation data, later articulation data and stationary data are transmitted to the previous articulation data storage unit 13, the later articulation data storage unit 14 and the articulation data storage unit 16 (S3).

Then, the characteristic parameter interpolation unit 15 picks up the characteristic parameter of the last frame of the previous articulation data stored in the previous articulation data storage unit 13 and the characteristic parameter of the first frame of the last articulation data stored in the later articulation data storage unit 1. Then the characteristic parameter of the sustained sound prosecuted is generated by linear interpolation of these two characteristic parameters (S4).

Also, the characteristic parameter of the stationary data stored in the stationary data storage unit 16 is provided to the characteristic parameter change extracting unit 18, and the fluctuation component of the characteristic parameter of the stationary data is extracted (S5). This fluctuation component is added to the characteristic parameter output from the characteristic parameter interpolation unit 15 in the adding unit K1 (S6). This adding value is output to the characteristic parameter correction unit 21 as a characteristic parameter of a sustained sound via the switch SW1, and correction of the characteristic parameter is executed (S9). On the other hand, the stochastic component of stationary data stored in the stationary data storage unit 16 is provided to the adding unit K2 via the switch SW2.

The spectrum envelope generating unit 23 generates a spectrum envelope for this corrected characteristic parameter. The harmonics amplitude/phase calculating unit 24 calculates an amplitude or a phase of each harmonics generated in the harmonic chain generating unit 22 in accordance with the spectrum envelope generated in the spectrum envelope generating unit 23. In the timbre transformation unit 25, the local peak position of the spectrum envelope generated in the spectrum envelope generation unit 23 is changed to output the spectrum envelope after transformation to the adding unit K2.

On the other hand, in the case that the obtained frame data is judged to be a transition part (NO) at Step S2, articulation data of the transition part is stored in the articulation data storing unit 17 (S7). Next, the frame reading unit 19 reads articulation data stored in the articulation data storage unit 17 as frame data in accordance with a time indicated by the timer 29, and divides into characteristic parameters and the stochastic component to output (S8). The characteristic parameters are output to the characteristic parameter correction unit 21, and the stochastic component is output to the timbre transformation unit 26 via the switch SW2. In the timbre transformation unit 26, this stochastic component is changed by the mapping function Mf' generated corresponding to the timbre transformation parameter from the timbre transformation parameter adjustment unit 26C, and the stochastic component after this transformation is output to the adding K2. These characteristic parameters of the transition part undergo the same process as the characteristic parameter of the above sustained sound in the chacteristic parameter correction unit 21, the spectrum envelope generating unit 23, the harmonics amplitude/phase calculating unit 24 and the like.

Moreover, the switches SW1 and SW2 switch depending on types of the data being processed. The switch SW1 connects the characteristic parameter correction unit 21 to the adding unit K1 during processing the sustained sound and connects the chacteristic parameter correction unit 21 to the frame reading unit 19 during processing the transition part. The switch SW 2 connects the timbre transformation unit 26 to the stationary data storage unit 16 during processing the sustained sound and connects to the timbre transformation unit 26 to the frame reading unit 19 during processing the transition part.

When the transition part, the characteristic parameter of the sustained sound and the stochastic component are calculated, these values are processed in the inverse FFT unit 27, and they are overlapped in the overlapping unit 28 to output a final synthesized waveform (S10).

The present invention has been described in connection with the preferred embodiments. The invention is not limited only to the above embodiments. For example, in the above embodiment, the timbre transformation parameter is expressed as a form of mapping function, and the timbre transformation parameter may be included in the singing performance data storage unit 11 as MIDI data.

Also, in the above embodiment, the local peak frequencies of the spectrum envelope as an output from the spectrum envelope generating unit 23 are defined as targets of adjustment by the mapping function. The adjustment target may be whole spectrum envelope or an arbitrary part, and not only the local peak frequencies, other parameter expressing the spectrum envelope such as amplitude and the like may be an adjustment target. Also, the characteristic parameter (for example, EGain, ESlopeDepth and the like) read out from the phoneme database 10 may be adjusted.

Also, the characteristic parameter output from the characteristic parameter correcting unit 21 may be changed. At this time, every type of each characteristic parameter may have mapping function.

Also, either one of the deterministic component or the stochastic component may be amplified or attenuated based on the timbre transformation parameter before the adding unit K2, and it may be added in the adding unit K2 after changing the rate. Also, only the deterministic component may be adjusted. Also, a time axis signal output from the inverse FFT unit 27 may be adjusted.

Also, the mapping function may be expressed by a following equation (B):

$$fout=(fs/2)\times(2\times fin/fs)^{\alpha} \qquad (B)$$

Figure 7:
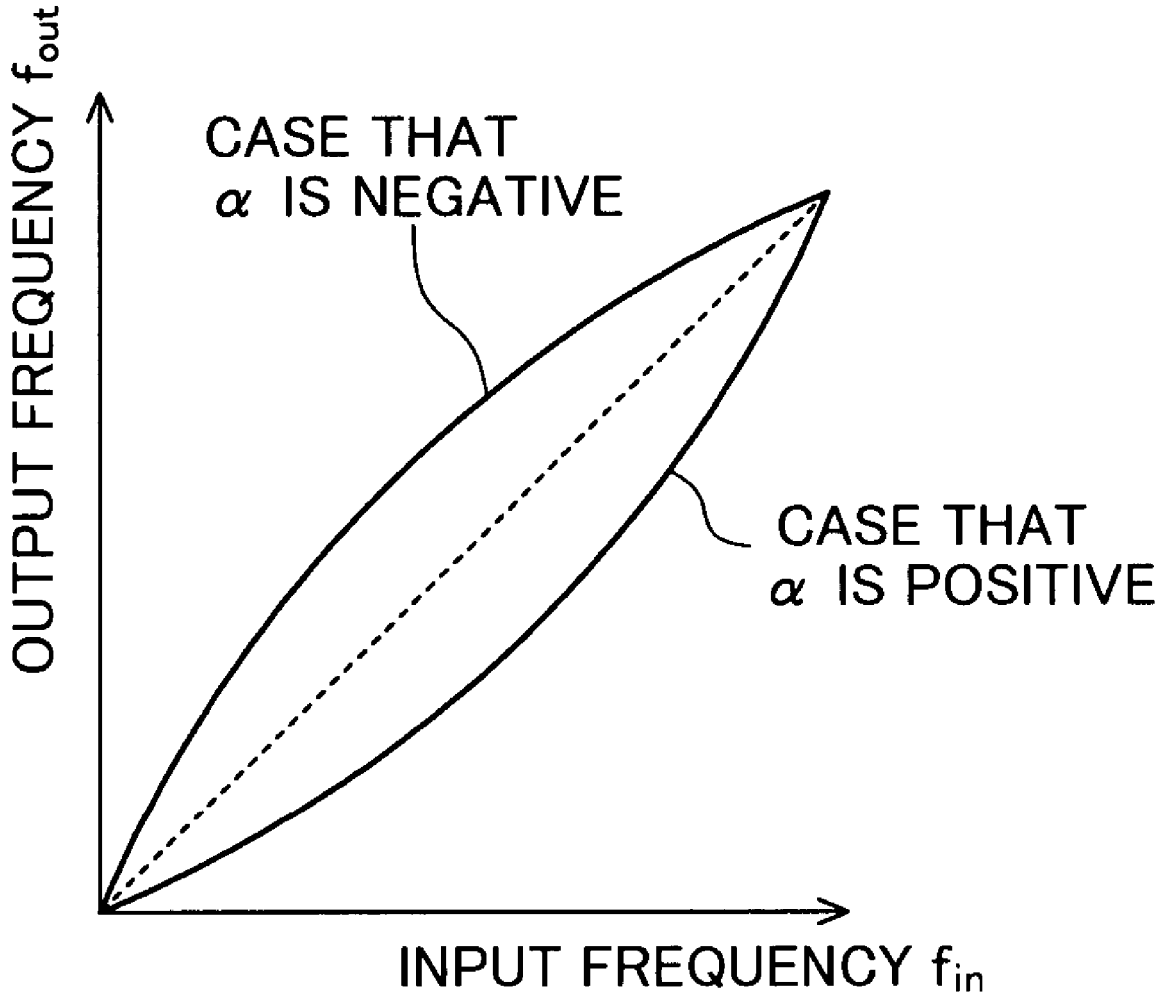
FIG. 7 shows another example of the mapping function Mf.

Where, "fs" is a sampling frequency, "f in" is an input frequency, and "f out" is an output frequency. Also, "α" is a factor to determine whether it makes the output singing voice a male voice or a female voice. When "α" is a positive value, the mapping function expressed by the equation (B) will be a convex function, and the output singing voice will be a male voice. Also, when "α" is a negative value, the output singing voice will be a feminine or childish voice (refer to FIG. 7).

Also, some points (breaking points) can be specified on a coordinate system expressing the mapping function and a mapping function can also be defined as a straight line which connects them. In this case, the timbre transformation parameter can be expressed as a vector by a coordinate value.

The present invention has been described in connection with the preferred embodiments. The invention is not limited only to the above embodiments. It is apparent that various modifications, improvements, combinations, and the like can be made by those skilled in the art.

What are claimed are:

1. A singing voice synthesizing apparatus, comprising:

a singing voice information input device that inputs singing voice information for synthesizing a singing voice;

a phoneme database that stores voice synthesis unit data;

a selector that selects the voice synthesis unit data stored in the phoneme database in accordance with the singing voice information;

a timbre transformation parameter input device that inputs a timbre transformation parameter for transforming timbre, the timbre transformation parameter including a coefficient α indicating whether a singing voice is made to be feminine or masculine;

a mapping function generator that generates, in accordance with the coefficient included in the timbre transformation parameter, a mapping function defined by a following equation (1)

$$fout = (fs/2) \times (2 \times fin / fs)^{\alpha} \quad (1),$$

where fout is an output frequency, fs is a sampling frequency, fin is an input frequency and α is the coefficient indicating whether the singing voice is made to be feminine or masculine; and a singing voice synthesizer that generates a spectrum envelope based on the selected voice synthesis unit data, transforms the generated spectrum envelope in accordance with the mapping function generated by using a local peak frequency of the spectrum envelope as the input frequency, and generates a synthetic singing voice of which character is changed by using the transformed spectrum envelope.

2. A singing voice synthesizing apparatus according to claim 1, further including a characteristic parameter output device that derives a characteristic parameter from the voice synthesis unit data selected by the selector and outputs the derived characteristic parameter, and wherein the singing voice synthesizer corrects the characteristic parameter in accordance with the timbre transformation parameter.

3. A singing voice synthesizing apparatus according to claim 1, wherein the timbre transformation parameter input device includes a timbre transformation parameter adjuster that changes the timbre transformation parameter in a time axis.

4. A singing voice synthesizing method, comprising:

inputting singing voice information for synthesizing a singing voice;

storing voice synthesis unit data into a phoneme database in advance and selecting the voice synthesis unit data stored in the phoneme database in accordance with the singing voice information;

inputting a timbre transformation parameter for transforming a timbre, the timbre transformation parameter including a coefficient α indicating whether a singing voice is made to be feminine or masculine;

generating, in accordance with the coefficient included in the timbre transformation parameter, a mapping function defined by a following equation (1)

$$fout = (fs/2) \times (2 \times fin/fs)^{\alpha}(1)$$

where fout is an output frequency, fs is a sampling frequency, fin is an input frequency, and α is the coefficient indicating whether the singing voice is made to be feminine or masculine; generating a spectrum envelope based on the selected voice synthesis unit data;

transforming the generated spectrum envelope in accordance with the mapping function generated by using a local peak frequency of the spectrum envelope as the input frequency; and generating a synthetic singing voice of which character is changed by using the transformed spectrum envelope.

5. A computer-readable storage medium having encoded thereon a singing voice synthesizing program including instructions which when executed by a computer causes:

inputting singing voice information for synthesizing a singing voice;

storing voice synthesis unit data into a phoneme database in advance and selecting the voice synthesis unit data stored in the phoneme database in accordance with the singing voice information;

inputting a timbre transformation parameter for transforming timbre, the timbre transformation parameter including a coefficient α indicating whether a singing voice is made to be feminine or masculine;

generating, in accordance with the coefficient included in the timbre transformation parameter, a mapping function defined by a following equation (1)

$$fout = (fs/2) \times (2 \times fin/fs)^{\alpha}(1)$$

where fout is an output frequency, fs is a sampling frequency, fin is an input frequency, and α is the coefficient indicating whether the singing voice is made to be feminine or masculine;

generating a spectrum envelope based on the selected voice synthesis unit data;

transforming the generated spectrum envelope in accordance with the mapping function generated by using a local peak frequency of the spectrum envelope as the input frequency; and generating a synthetic singing voice of which character is changed by using the transformed spectrum envelope.

* * * * *